United States Patent [19]

Takamaru et al.

[11] 4,225,535

[45] Sep. 30, 1980

[54] ACCELERATION PUMP OF CARBURETOR

[75] Inventors: Takeshi Takamaru; Mineo Kashiwaya; Kiyomi Morita; Seijl Oobayashi, all of Katsuta, Japan

[73] Assignee: Hitachi, Ltd., Japan

[21] Appl. No.: 926,112

[22] Filed: Jul. 19, 1978

[30] Foreign Application Priority Data

Aug. 25, 1977 [JP] Japan ..... 52-102041

[51] Int. Cl.[3] ..... F02M 7/08

[52] U.S. Cl. ..... 261/34 B; 92/13; 92/13.1

[58] Field of Search ..... 261/34 B; 92/13, 13.1

[56] References Cited

U.S. PATENT DOCUMENTS

| | | | |
|---|---|---|---|
| 1,881,996 | 10/1932 | Bicknell | 261/34 B |
| 2,048,727 | 7/1936 | Boyce | 261/34 B |
| 2,158,777 | 5/1939 | Renner | 261/34 B |
| 2,188,355 | 1/1940 | Hunt | 92/13 |
| 2,261,829 | 11/1941 | Cross | 92/13 |
| 2,293,792 | 8/1942 | Ball | 261/34 B |
| 2,355,346 | 8/1944 | Weber | 261/34 B |
| 2,438,463 | 3/1948 | Snader et al. | 92/13 |
| 3,269,711 | 8/1966 | Baldwin | 261/34 B |
| 3,313,530 | 4/1967 | Bickhaus et al. | 261/34 B |
| 3,313,531 | 4/1967 | Winkely et al. | 261/34 B |
| 3,957,929 | 5/1976 | Gural et al. | 261/34 A |
| 4,108,951 | 8/1978 | Niwa et al. | 261/34 B |

FOREIGN PATENT DOCUMENTS

| | | | |
|---|---|---|---|
| 740704 | 10/1943 | Fed. Rep. of Germany | 92/13 |

*Primary Examiner*—Tim R. Miles

*Attorney, Agent, or Firm*—Craig and Antonelli

[57] ABSTRACT

In an acceleration pump of a carburetor for an internal combustion engine including a cylinder and a piston reciprocatorily inserted in the cylinder, the piston is formed in its upper portion with a transverse bore for a stopper member to extend therethrough to be urged by a heat sensitive element to move in a direction at right angles to the direction of reciprocatory movement of the piston, so that additional fuel for acceleration can be supplied to the engine in a quantity which is accurately corrected to accommodate itself to changes in ambient temperature, by means of the heat sensitive element. The transverse bore is formed at its top wall and bottom wall with projections, and the stopper member is formed at its upper surface and lower surface with depressed portions, so as to enable the lengths of the downward and upward strokes of the piston to be controlled in accordance with changes in ambient temperature. Thus the acceleration pump is capable of supplying to the engine additional fuel for acceleration in a quantity which is corrected to accommodate itself for changes in ambient temperature.

4 Claims, 2 Drawing Figures

ACCELERATION PUMP OF CARBURETOR

BACKGROUND OF THE INVENTION

This invention relates to an acceleration pump of a carburetor for an internal combustion engine and more particularly to an improvement provided in the acceleration pump for enabling the same to accurately regulate the quantity of additional fuel for acceleration supplied to the engine depending on the ambient temperature.

Nowadays there is a growing need to effect control of the quantity of additional fuel for acceleration supplied to an internal combustion engine, particularly for use in an automotive vehicle, by an acceleration pump of a carburetor in accordance with a change in the ambient temperature. To attain this end, proposals have been made to employ a wax or other heat sensitive element to vary the length of downward stroke of a piston inserted for reciprocatory movement in a cylinder of the acceleration pump so as to thereby regulate the quantity of additional fuel for acceleration discharged by the acceleration pump. One example of the acceleration pump of this type is described in detail in U.S. Ser. No. 841,736 filed by Inoue et al on Oct. 13, 1977, now U.S. Pat. No. 4,157,365.

The acceleration pump device described in the aforesaid application is constructed such that it automatically diminishes the quantity of additional fuel for acceleration supplied to the engine when the ambient temperature rises and increases the quantity of the acceleration fuel when the ambient temperature falls. This device can satisfactorily accomplish the object of regulating the acceleration fuel as has been planned.

However, research further conducted into the engine operating condition and the air-polluting constituents of the exhaust gases of internal combustion engines has revealed that, when the ambient temperature is high, no acceleration fuel need be supplied to the engine until the degree of opening of the throttle valve reaches a certain level and only a small quantity of acceleration fuel need be supplied to the engine even when the throttle valve has been opened widely. In the acceleration pump device referred to hereinabove, the fuel discharging characteristic of the pump is determined irrespective of the ambient temperature, if no fuel is allowed to be discharged by the acceleration pump until the opening of the throttle valve reaches a predetermined level from idling. Thus the aforesaid device is not capable of supplying acceleration fuel in a quantity which is actually required for obtaining smooth acceleration at small throttle opening when the ambient temperature is low.

SUMMARY OF THE INVENTION

This invention has as its object the provision of an acceleration pump of a carburetor for an internal combustion engine which enables a good engine operating condition and a favorable exhaust gas characteristic to be obtained at all times, in accordance with a change in ambient temperature.

The outstanding characteristic of the present invention is that depressed portions are formed at upper and lower surfaces of a stopper member adapted to be operated by a heat sensitive element and inserted in a transverse bore formed in a piston and having a diameter larger than the outer diameter of the stopper member. The transverse bore is formed, at its top wall and bottom wall, with projections adapted to be brought into and out of engagement with the stopper member, so as to vary the lengths of upward and downward strokes of the piston in accordance with a change in ambient temperature.

DETAILED DESCRIPTION OF THE PREFERRED EMBODIMENT

Figure 1:
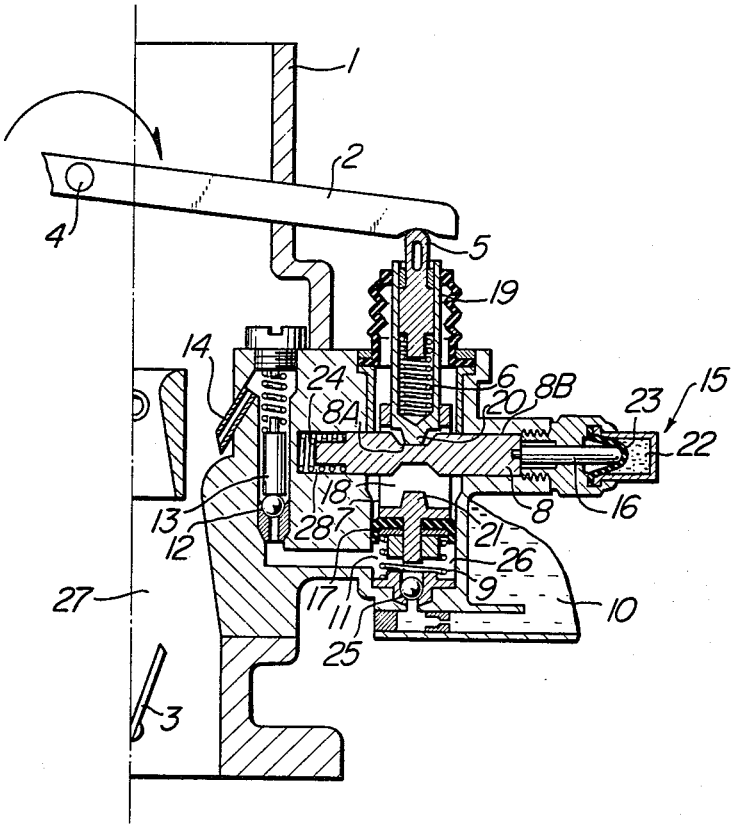
FIG. 1 is a vertical sectional view of the acceleration pump of a carburetor comprising one embodiment of the invention.

Referring to FIG. 1, a carburetor body 1 has mounted thereon a pump lever 2 which is pivotally supported by a lever supporting shaft 4. When a throttle valve 3 is opened, the pump lever 2 is pivotally moved in the direction of an arrow to depress a pump rod 5 housed in a cylindrical member 19 for vertical reciprocatory movement. Downward movement of the pump rod 5 compresses a damper spring 6 mounted in the cylindrical member 19 to thereby move the cylindrical member 19 downwardly. A piston 7 is firmly secured to a lower end of the cylindrical member 19, so that downward movement of the cylindrical member 19 causes the piston 7 to move downwardly in a pump cylinder 26 in which the piston 7 is inserted. Upon the piston 7 moving downwardly, a valve 17 mounted in the piston 7 opens and permits liquid fuel in a pump chamber 11 to be discharged, by lifting an outlet valve 12 and a weight 13, into a mixture conduit 27 through an injector 14. The lower limit of the downward stroke of the piston 7 is determined by a stopper member 8 inserted and extending horizontally in a transverse bore 18 of a large size formed in the piston 7. More specifically, when a projection 20 formed at a lower end of the cylindrical member 19 or at a top wall of the bore 18 to extend downwardly abuts against the stopper member 8, the piston 7 becomes stationary, thereby regulating the quantity of liquid fuel discharged by the acceleration pump in accordance with the position in which the projection 20 abuts against the stopper member 8.

The stopper member 8 is circular in cross sectional shape and includes a minor diameter portion 8A and major diameter portions 8B, with its central portion being smaller in diameter than its peripheral portions and the major diameter portions 8B and the minor diameter portion 8A being contiguous with one another through tapered portions. The stopper member 8 is in contact at its left end with a compression spring 24 mounted in a blind transverse hole 28 formed in the carburetor body 1, and at its right end with a needle 16 of a heat sensitive element assembly 15 comprising wax 22 or other material of thermal expansivity, adapted to become fluid at high temperature, which is sealed by a bellowsphragm 23. Thus, when the temperature rises, the wax expands and causes the needle 16 to move leftwardly in FIG. 1. Accordingly, a rise in the temperature of the carburetor body 1 (which may vary depending on the ambient temperature and the engine operating condition) results in the stopper member 8 being urged to move leftwardly in FIG. 1 against the biasing force of the compression spring 24, so that the projection 20 at the lower end of the cylindrical member 19 is brought into abutting engagement with the major diameter portion 8B interposed between the minor diameter portion 8A and the heat sensitive element assembly 15, thereby shortening the downward stroke of the piston 7. That is, when the ambient temperature rises, the quantity of additional fuel for acceleration discharged by the acceleration pump is reduced so as to automatically regulate the acceleration fuel to obtain an optimum acceleration performance. When the ambient temperature falls and the wax 22 contracts to cause the needle 16 to move rightwardly in FIG. 1, the stopper member 8 is moved rightwardly by the biasing force of the compression spring 24 to its original position in which the minor diameter portion 8A of the stopper member 8 comes into abutting engagement with the projection 20. When the stopper member 8 is in this position, the downward stroke of the piston 7 is lengthened, so that the acceleration fuel discharged by the acceleration pump increases in quantity.

When the degree of opening of the throttle valve 3 is reduced following the termination of the engine accelerating condition, the pump lever 2 moves counterclockwise in pivotal movement and releases the pump rod 5. Then the pump rod 5 and the piston 7 are moved upwardly by the elastic restoring forces of the damper spring 6 and a return spring 9 mounted in the pump chamber 11 and depressed by the lower end of the piston 7, and the piston 7 stops in a position in which it is brought into abutting engagement with the lower surface of the stopper member 8. Upward movement of the piston 7 opens an inlet valve 25 mounted in a lower portion of the pump chamber 11 to introduce liquid fuel by suction into the pump chamber 11 from a float chamber 10. At this time, the weight 13 is moved downwardly by the biasing force of a compression spring of weak resilience mounted thereon so as to close the outlet valve 12.

The important feature of the present invention is that means is provided for varying the length of upward stroke of the piston 7 depending on the temperature, when the degree of opening of the throttle valve 3 is reduced. More specifically, a projection or limiter 21 is formed at the bottom wall of the transverse bore 18 formed in the piston 7.

FIG. 1 shows the stopper member 8 in a position in which it is disposed at low temperature. When the stopper member 8 is in this position, the limiter 21 is brought into abutting engagement with the minor diameter portion 8A of the stopper member 8, and the upper end of the limiter 21 and other flat portions of the bottom wall of the transverse bore 18 are brought into engagement with the stopper member 8 substantially simultaneously. A rise in ambient temperature causes the stopper member 8 to move leftwardly against the biasing force of the compression spring 24, so that the limiter 21 is brought into abutting engagement with the tapered portion or the major diameter portion 8B interposed between the minor diameter portion 8A and the heat sensitive element assembly 15, thereby shortening the length of upward stroke of the piston 7 and reducing the volume of the pump chamber 11. That is, the quantity of the liquid fuel introduced into the pump chamber 11 by suction as the piston 7 moves upwardly is reduced with a rise in temperature, and the quantity of the liquid fuel discharged by the downward movement of the piston 7 is reduced. Stated differently, the length of stroke of the piston 7 is shortened in conformity with the configuration of the stopper member 8 with a rise in temperature.

Figure 2:
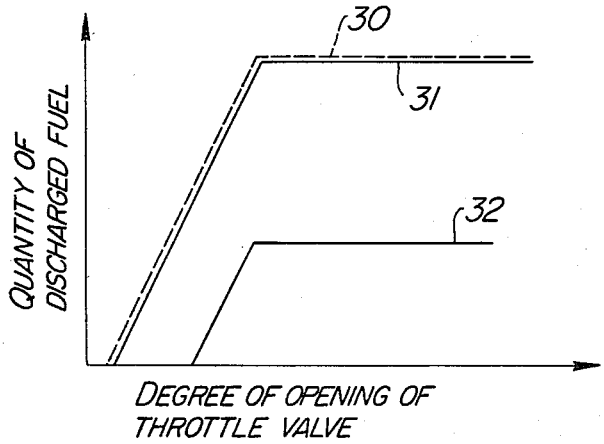
FIG. 2 is a diagrammatic view showing the relation between the degree of opening of the throttle valve and the quantity of additional fuel discharged by the acceleration pump.

FIG. 2 is a diagrammatic view showing the relation between the degree of opening of the throttle valve and the quantity of acceleration fuel discharged by the acceleration pump device. In FIG. 2, a broken line 30 represents the acceleration pump device proposed by Inoue et al and described in U.S. Ser. No. 841,736. The broken line 30 indicates that when the degree of opening of the throttle valve exceeds a certain level, the movement of the piston 7 is limited by the stopper member 8 and the quantity of acceleration fuel discharged by the device becomes constant. An inclined portion of the borken line 30 indicates the condition in which the piston 7 is floating due to equalization of the biasing force of the damper spring 6 and the force exerted by the pump lever 2 to depress the pump rod 5. A solid line 31 represents the accereleration pump according to the present invention operating at low temperature. The acceleration pump device according to the invention operates in the same manner as the acceleration pump device of Inoue et al.

A solid line 32 represents the acceleration pump according to the present invention operating at high temperature. When the throttle valve 3 commences to open in FIG. 1, the pump lever 2 slightly depresses the pump rod 5. At this time, the force exerted by the pump lever 2 merely causes the damper spring 6 to contract and does not cause the piston 7 to move downwardly. It is only after the degree of opening of the throttle valve 3 has reached a certain level that the piston 7 moves in its downward stroke to discharge the acceleration fuel through the injector into the mixture conduit 27. After the degree of opening of the throttle valve 3 has increased and the projection 20 at the lower end of the cylindrical member 19 has been brought into abutting engagement with the major diameter portion 8B of the stopper member 8, the force exerted by the pump lever 2 merely compresses the damper spring 6 and has no effect on the stroke of the piston 7. That is, the length of the downward stroke of the piston 7 is limited by the stopper member 8. The length of the upward stroke of the piston 7 is also limited by the stopper member 8 as aforesaid, so that the quantity of acceleration fuel discharged by the acceleration pump is reduced at high temperature.

From the foregoing description, it will be appreciated that the acceleration pump of the carburetor according to the present invention is capable of increasing the degree of opening of the throttle valve at which discharge of acceleration fuel into the mixture conduit commences and thereby reducing the quantity of the acceleration fuel when the ambient temperature is high, by virtue of a simple structural feature of providing a projection or a limiter at the bottom wall of the transverse bore formed in the piston. Thus the invention offers the advantages that an optimum engine operating condition can be obtained at all times by regulating the accelerating fuel depending on the ambient temperature, that the fuel consumption can be reduced, and that the air-polluting constituents of engine exhausts, such as carbon monoxide and hydrocarbons, can be reduced.

Experiments were carried out by using an automotive vehicle on which a carburetor provided with the acceleration pump according to the present invention was mounted. The results of a ten mode test conducted under the condition of high ambient temperature show, inter alia, that the amount of carbon monoxide in the engine exhausts has been reduced from 2 g/Km to 1.4 g/Km.

The acceleration pump of the carburetor according to the invention can achieve the excellent effects of enabling a good engine operating condition and a favorable exhaust gas characteristic to be obtained at all times, in accordance with a change in ambient temperature.

What is claimed is:

1. An acceleration pump of a carburetor comprising:

a throttle valve located in a mixture conduit of a carburetor body;

a pump cylinder formed in the carburetor body and charged with acceleration fuel;

a piston operative to discharge the fuel from said pump cylinder into said mixture conduit in response to an opening action of said throttle valve; and temperature-fuel compensating means operative to control the operation of said piston in such a manner that said piston initiates discharge of the fuel from said pump cylinder at a first degree of opening of said throttle valve which is higher when ambient temperature is high than when ambient temperature is low and said piston terminates discharge of the fuel from said pump cylinder at a second degree of opening of said throttle valve which is lower when ambient temperature is high than when ambient temperature is low;

wherein the amount of fuel discharged by said piston is determined by said first and second degrees of opening of said throttle valve in such a manner that the fuel can be reduced in amount when ambient temperature is high as compared with the amount of fuel discharged when ambient temperature is low, and wherein said temperature-fuel compensating means comprises a heat sensitive element, and a stopper member driven by said heat sensitive member to vary the maximum displacement of said piston both in discharge and suction directions in such a manner that the maximum displacement of said piston in the discharge direction is smaller when ambient temperature is high than when ambient temperature is low and the maximum displacement of the piston in the suction direction is greater when ambient temperature is low than when ambient temperature is high.

2. An acceleration pump as set forth in claim 1, wherein said temperature-fuel compensating means further comprises a transverse bore formed in said piston for inserting said stopper member therein for movement by the action of said heat sensitive element, and major diameter portions formed in said stopper member with their diameters increased in the direction of movement of said piston as compared with other portions of said stopper member, and wherein the maximum displacement of said piston both in the discharge and suction directions is determined by the cooperation of one of said major diameter portions of said stopper member with said transverse bore when ambient temperature is high and by the cooperation of other portions of said stopper member than said major diameter portions with said transverse bore when ambient temperature is low.

3. An acceleration pump as set forth in claim 2, wherein said stopper member is held between a compression spring mounted at one end of a transverse hole formed in the carburetor body and said heat sensitive element mounted at the other end of the transverse hole and moved in sliding movement in the transverse hole by said heat sensitive element.

4. An acceleration pump as set forth in claim 1, wherein said heat sensitive element is formed of a material undergoing a marked change in volume when the material changes from a solid state to a liquid state at elevated temperatures.

* * * * *